US005906009A

United States Patent [19]

Sakar

[11] Patent Number: 5,906,009

[45] Date of Patent: May 25, 1999

[54] TOILET BOWL NOXIOUS FUME AND MIST EVACUATION

[76] Inventor: Josip Sakar, 2424 Mundale Ave., Dayton, Ohio 45420

[21] Appl. No.: 09/032,811

[22] Filed: Mar. 2, 1998

[51] Int. Cl.[6] ..... E03D 9/05

[52] U.S. Cl. ..... 4/216; 4/213

[58] Field of Search ..... 4/213, 347, 348, 4/217, 352, 216, 218

[56] References Cited

U.S. PATENT DOCUMENTS

| | | | |
|---|---|---|---|
| 997,442 | 7/1911 | Diffenderfer | 4/213 |
| 1,401,091 | 12/1921 | Lucas | 4/213 |
| 1,513,168 | 10/1924 | Frick | 4/217 |
| 1,883,406 | 10/1932 | Ronning | 4/213 |
| 1,885,715 | 11/1932 | Hanson | 4/213 |
| 2,074,211 | 3/1937 | Churchill | 4/213 |
| 2,240,130 | 4/1941 | Carothers | 4/213 |
| 2,371,923 | 3/1945 | Sanford et al. | 4/213 |
| 2,724,840 | 11/1955 | Scott et al. | 4/213 |
| 2,728,921 | 1/1956 | Dorko | 4/216 |
| 4,882,790 | 11/1989 | Ricard | 4/213 |
| 4,893,359 | 1/1990 | Vu et al. | 4/216 |
| 5,179,737 | 1/1993 | Ricard | 4/213 |
| 5,522,093 | 6/1996 | Schaffer | 4/213 |

FOREIGN PATENT DOCUMENTS

| | | | |
|---|---|---|---|
| 2202611 | 7/1973 | Germany | 4/213 |
| 1419782 | 12/1975 | United Kingdom | 4/213 |

*Primary Examiner*—Charles R. Eloshway
*Attorney, Agent, or Firm*—William Weigl

[57] ABSTRACT

A toilet bowl has gases and bacteria or virus-laden mist removed directly therefrom by an air evacuation system, both during and after use of the toilet. The system can also include apparatus for forced air dispensing of air-freshening deodorant or disinfectant during the air evacuation from the bowl, which dispensing apparatus is driven by but is independent from the flow of air and gas or mist exhausted during evacuation. The air evacuation system may be associated with a dedicated vacuum-creating pump or be integral with a ceiling exhaust fan which has the capability of either exhausting air from the bathroom or through the toilet bowl air evacuation system.

5 Claims, 3 Drawing Sheets

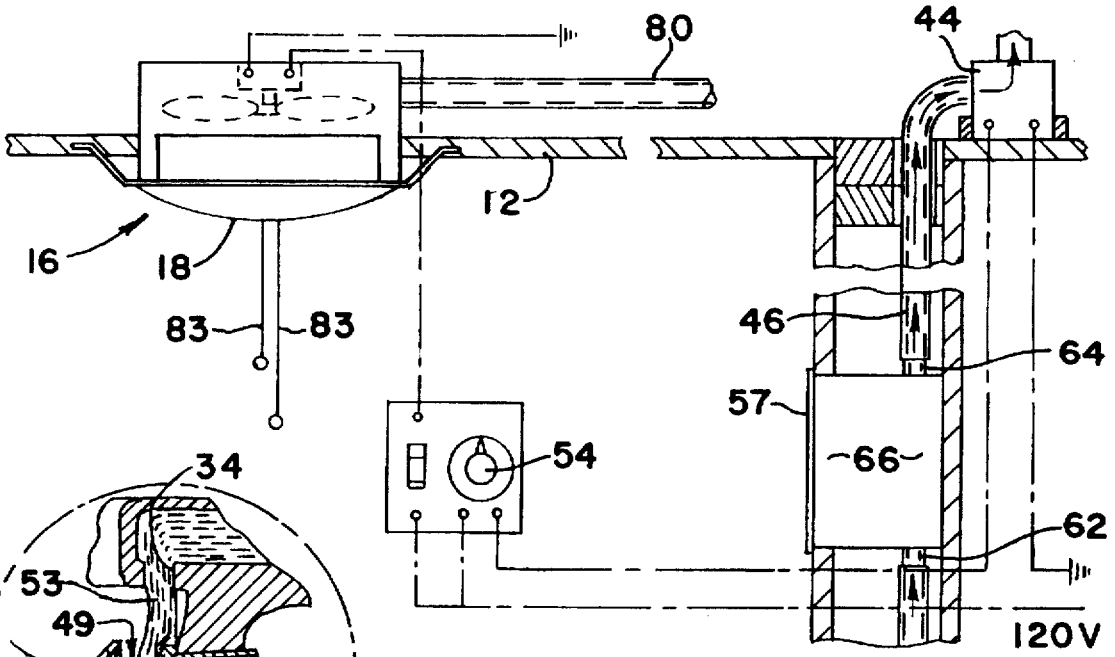
FIG. 1
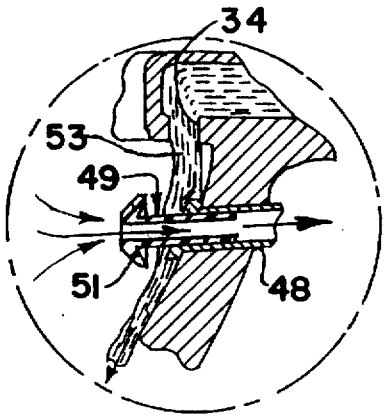
FIG. 7
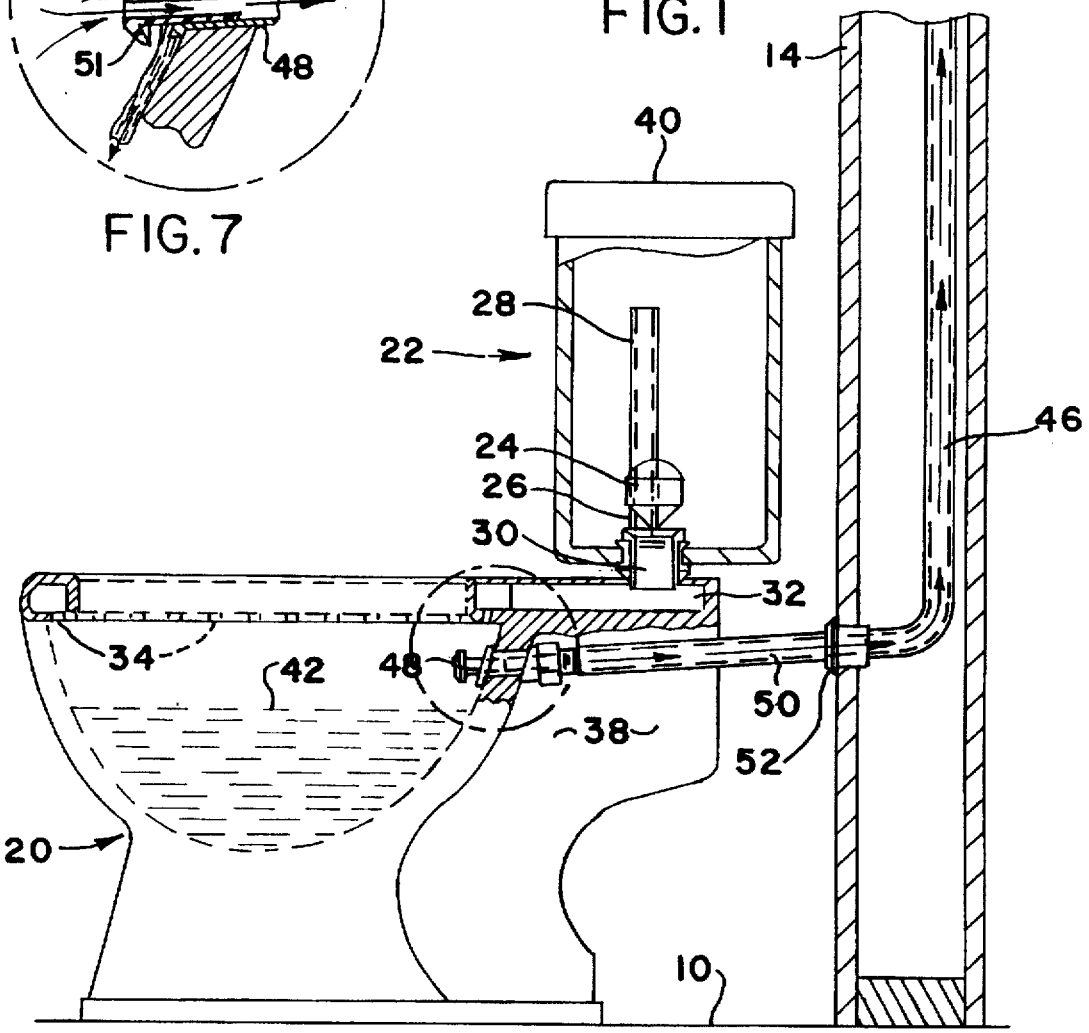

TOILET BOWL NOXIOUS FUME AND MIST EVACUATION

This invention relates to a system for evacuation air directly from a toilet bowl both during and after use to remove noxious fumes and to minimize undesirable distribution of bacteria, viruses and liquid mist during flushing of or urination into a toilet.

BACKGROUND OF THE INVENTION

Attempted elimination of the noxious odor of human solid waste from a bathroom has been addressed in many ways, including exhaust fans, aerosol-dispensed air freshening deodorants, water-wasting flushings during defecation and, particularly in the patent art, by a variety of systems for evacuating air through the toilet tank and bowl, directly through an upper area of the bowl itself or from beneath the seat, and conveying the air to a remote location. To date, I know of no system of the latter types which has been successful in the marketplace. Of the techniques other than bowl air evacuation, they function only nominally at best, and in some instances, even worsen the situation. In the case of turning on a conventional ceiling exhaust fan while sitting on a toilet, gases from within the bowl may be drawn out between the top of the bowl and the seat and flow directly past the nostrils of the person seated, compounding an unpleasant olfactory situation. Most households appear to use the deodorant approach to mask noxious odors, but the deodorant is normally not used until the individual is ready to leave the bathroom, because of the mist it creates. The intermediate solution (before leaving) is commonly to flush the toilet one or more times during use, and use the air freshener only upon leaving.

Any air evacuation system, if it were effective, would have the potential for tremendous water savings by eliminating excessive flushings that some individuals are prone to be doing if their visit to the bathroom is more than a few minutes. Such flushings would become unnecessary if the odor could be effectively removed directly from the bowl area while remaining seated. Furthermore, if a user flushes the toilet while still seated, his or her underside is exposed to potentially harmful bacteria and viruses which may be residing in the toilet. In an article in Ladies' Home Journal in January, 1995, microbiologist Joe Rubino was interviewed. The article states that "every time you flush, thousands of bacteria and virus particles are catapulted into the air, floating at least five feet up and five out." Rubino is quoted as saying "A fine mist will spread to all kinds of surfaces around the bowl." Unfortunately, if the mist can be catapulted to the extent noted above, bacteria and viruses would most certainly be deposited on a person's bare underside if he or she flushes the bowl while remaining on the toilet. It is well known in the medical profession that the warm, moist areas around a person's private parts are a natural garden for growth of germs and disease.

While an influenza virus will survive on a hard surface such as a toilet bowl for only a few hours, says the article, a hepatitis A virus, by contrast, can live as long as thirty days. No one can state with any degree of certainty how significant or insignificant toilet bowls are in the transmission of disease such as an influenza epidemic, but anything to reduce the spread of germs has the potential of playing an important part in minimizing health problems in times of danger. The cost of resolving wide-spread disease which may originate in or be spread by toilet flushing, as well as the misery caused by disease, while addressed in public health forums, does not appear to have been considered in the designs of toilets themselves or of systems which function with toilets. Nor does the potential water savings made possible by eliminating the desire or perceived need to frequently flush appear to have been considered as an important side benefit of a toilet designed with an effective air evacuation system. Water is one of the world's greatest natural resources, and its conservation is a worthwhile goal, no matter how it is achieved.

Numerous patents teach the utilization of the water passageway between a toilet tank and bowl to also exhaust air. Representative of such patents are U.S. Pat. No. 5,321,856 to Gastesi, U.S. Pat. No. 3,763,505 Zimmerman, U.S. Pat. No. 2,105,794 to Norris and U.S. Pat. No. 4,017,916 to Pearson. While this approach might seem to be effective, it has certain inadequacies which may account for the approach apparently never having been adopted commercially, at least not to my knowledge. First, the solution is ineffective to exhaust air during the same short period of time that water is being directed through the passageway from the tank through the standard holes or slots in the underside of the bowl rim. This time period, while probably only about fifteen seconds in duration, is during the very same time when mist creation is at its maximum, and when the need for mist evacuation is the greatest. Second, since a tank cover or lid must necessarily permit air to flow into the tank to maintain the tank at atmospheric pressure, any air evacuation system which has its inlet within the tank may draw as much, if not more, air from between the tank top edge and its lid than it is capable of pulling through the toilet standpipe and bowl rim holes, thus reducing its effectiveness for bowl air evacuation. Third, it is not possible to evacuate either air or mist in a direction opposite to the direction of water flow through the rim holes or slot while flushing.

In addition, U.S. Pat. No. 1,885,715 to Hanson and U.S. Pat. No. 1,401,091 to Lucas evacuate air through openings directly connected to the inside of the toilet bowl above the normal water level. Both have been part of the patent art for more than a half-century, and, to the best of my knowledge, have not been used commercially. The Lucas design has the inherent problem of entraining flush water while it cascades as a sheet down the inside surface of the bowl, if air evacuation was intended to take place while flushing. This would inhibit mist or air evacuation during flushing. While Hanson avoided that problem by placing an inverted baffle over the air intake holes in the back wall of the bowl, his entire volume of flush water was cascaded over the narrow baffle, undoubtedly creating a miniature waterfall and thus forming a sheet or wall of water which would cover the air intake holes until the tank fully emptied into the bowl. During that time, except for a possible small amount of mist beneath the waterfall and any residual mist remaining in the bowl once the waterfall subsided, the system's effectiveness for mist removal was minimal, at best. Neither design is susceptible to being retrofitted to existing toilets in kit form. Both of the above patents became public knowledge at a time when the germ-spreading effects of toilet bowl mist were not appreciated. The concern of the patentees was apparently only noxious fume elimination, with no consideration being given to the need to minimize or avoid a health risk.

SUMMARY OF THE INVENTION

This invention utilizes an air evacuation or vacuum system to remove air and mist directly from a toilet bowl and convey the air to a remote location such as an attic or roof of a house. By enabling a user to control the timing of the evacuation, a bowl can be exhausted while a person sits on the seat and continuing after leaving the room. While sitting, air from waste deposited in the water or remaining at the person's anus is removed and conveyed elsewhere. A auxiliary air circulating system may be independently driven by the air evacuating system to dispense disinfectant or deodorant into the room. While flushing, bacteria and virus-laden mist can also be captured by the evacuation system, minimizing the potential spread of disease. Although the normal splashing caused during male urination into a toilet creates large droplets as well as a mist, the mist can also be removed and the splashing minimized by the pull of the vacuum.

It is a principal object of the invention to eliminate the need for frequent flushing of a toilet while a person is seated, with all the attendant benefits of saving water and minimizing the spread of germs and infectious disease.

Another object is to achieve mist evacuation at the time of greatest need, by projecting the evacuation intake means inwardly of the bowl's inner surface so as to maintain the intake unobstructed by the sheet of water flowing down the surface during flushing.

A further object is to enable dispensing of a non-aerosol air freshening deodorant or disinfectant while the air evacuation system is in operation, such dispensing being obtained without the cost of any additional operating mechanism.

Another object is to provide a ceiling fan which has the capability of having its air intake selectively open or closed also to be used as the source of vacuum for exhausting air from the toilet bowl.

Other objects and advantages will become apparent from the following description, in which reference is made to the accompanying drawings.

DESCRIPTION OF THE DRAWINGS

FIG. 1 is an elevational, partly fragmentary view of the total air evacuating system within a house bathroom, illustrating two different sources of vacuum.

FIG. 7 is a fragmentary enlarged view of a portion of FIG. 1, illustrating how air flow is kept unobstructed by the flow of flush water.

DESCRIPTION OF THE PREFERRED EMBODIMENT

Figure 3:
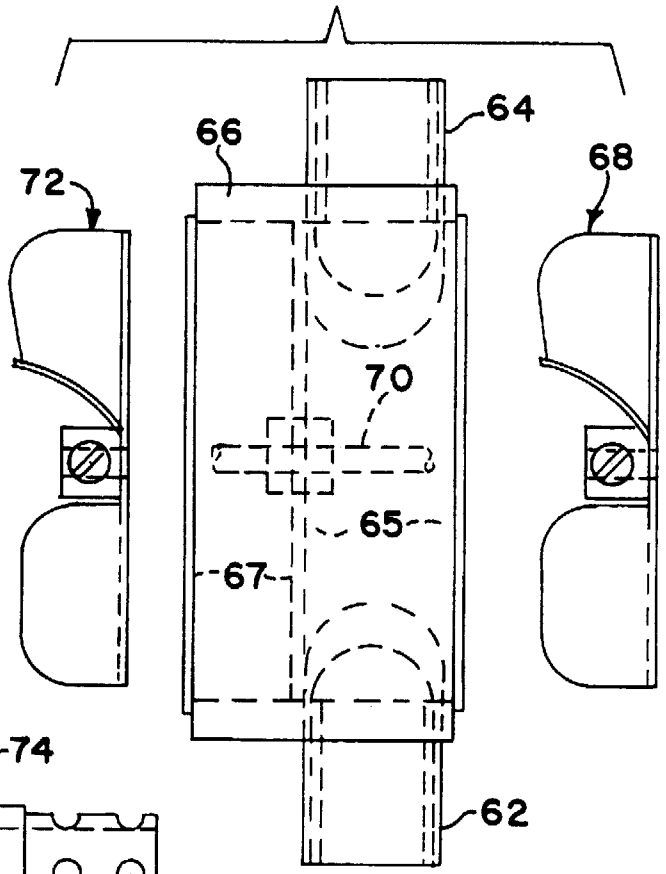
FIGS. 2–4 are details of an air circulating system which may be associated with the air evacuation system, the circulating system utilizing the flow of evacuating air to drive an impeller for circulating air freshener or disinfectant.

For simplicity of description, the invention will be disclosed in a home bathroom environment, although it may have significant value in an institution such as a hospital or any place of public gathering of individuals who may be carrying infectious disease. Particularly in a hospital, the spread of infectious disease can be reduced by the system's beneficial capability of dispensing disinfectant. In institutional use, multiple toilets can be connected to a common, central source of vacuum which also includes means for killing off any bacteria or virus.

A bathroom of a house is usually fully enclosed but has a floor 10, a ceiling 12 and at least one vertical wall 14. An exhaust fan 16 is typically mounted in the ceiling, and may often incorporate an overhead lamp 18 as well. Controls for the fan 16 and lamp 18 may be conventional, except that the air intake for the fan may be selectively open or closed if the fan is also the source of a vacuum which is an essential part of the invention. This will be described later in connection with a second illustrated form of the invention. National, state and large city building codes require use of an exhaust fan to remove moist air and steam from a shower in instances where no window is provided in a bathroom.

A conventional toilet bowl 20, (shown minus the usual seat since the seat itself does not constitute a part of the invention), is positioned adjacent the wall 14 and has mounted at a top rear portion the customary water tank 22. The particular type of toilet and its water supplying means for flushing is immaterial, and the home variation of toilet is shown herein merely for illustrative purposes. (In an institutional environment, for example, tanks 22 may not be used, flush water being supplied through valved pressure lines from a central source.) The tank shown has a bulb valve 24 which functions with a valve seat 26 to retain the tank water at a desired level determined by a float, the level being maintained below the top of an overflow standpipe 28. For simplicity, the operating mechanism for flushing to operate the valve has not been shown. When flushing takes place by lifting the bulb valve 24, water flows by gravity from the tank 22 through a connecting pipe 30 which has the valve seat 26 at its upper edge, through a hollow space 32, then out through holes 34 in the underside of a peripheral rim 36 at the upper edge of and surrounding the bowl 20. Some toilet bowls, instead of utilizing holes 34, are slotted to provide the same function as the holes, but at a lower noise level. The water supply already in the bowl is forced out with solid waste through a conventional trap area 38 at the rear of the bowl 20, to a connecting sewer line. The flow should be rapid to effectively force the bowl contents outwardly to the sewer. Older homes had tank water supplies of about 4.5 gallons, while newer household toilets have tank capacities believed to be using about 1.5 or 1.6 gallons per flush. With the reduced water volume available for each flush with newer toilets, it is essential that nothing inhibit the water flow, for if all contents are not flushed to the sewer, a reflushing may be necessary and water will be wasted in that manner. A conventional removable cover or lid 40 is positioned atop the tank 22. This lid is not airtight against the upper edge of the tank, since the air above the water in the tank is desired to be kept at atmospheric in order to enable flushing flow to be uninhibited.

Referring specifically now to the improvements provided by my invention, I connect the bowl 20 of the toilet, just above the level 42 of water in the bowl, directly to an electrically-operated vacuum pump 44 by means of a flexible conduit in the form of a hollow tube 46 having an inside diameter of approximately three quarters of an inch. A hollow nipple 48 may pass through an opening or hole at the rear portion of the bowl, which opening is preferably provided in the bowl by the toilet manufacturer in the molding process. The opening is intended to be capped with a removable plug during manufacture and is left that way if my invention is not utilized with the toilet. A pair of holes may be used at opposite sides of the rear of the toilet, so that either or both may be connected to a vacuum source. For older construction, the opening may be made with a diamond drill by an installer of the system of my invention. Any of several common clamping and sealing methods of connecting the tube 46 to the bowl 20 and pump 44 and any joints in between may be used, and will not be discussed herein in detail.

The motor of the vacuum pump 44 is preferably of the brush type used in vacuum cleaners and operable with either alternating or direct current. Such motors are capable of running at a quite high number of revolutions per minute and can produce the necessary vacuum to properly evacuate the small (about one-and-one-half cubic foot) air space of the bowl 20 through the tube 46. The tube used, being flexible, is easily passed between studs in a common plastered wall from a hole just behind and slightly above the nipple 48 to the pump 44. The latter may be located in an attic and possibly exhausted either outside the home or into a disinfecting air filter. A standard, aesthetically pleasing chromium plated tube 50 and associated cover ring 52, the only parts of the air evacuating system easily visible to a user may be used to cover the flexible tube 46 between the wall 14 and the nipple 48. The portion of tube 46 between the wall 14 and the nipple 48. The portion of tube 46 between the toilet 20 and wall 14 is inclined slightly downwardly toward the toilet so as to permit any liquid which may enter the tube 46 to drain back into the bowl. The nipple 48 will normally be placed as close beneath the rim 36 as possible, well above the water level 42. A tubular insert 49 is grippingly fitted into the nipple 48 and projects inwardly a short distance into the bowl, as shown in detail in FIG. 7. An annular flange 51 is provided around the intake opening of the insert so that cascading water 53 exiting from the rim holes 34 immediately thereabove cannot obstruct the intake entrance of air and mist into the insert 49 while flushing is taking place. The nipple 48 is preferably stainless steel to prevent corrosion, and the insert 49 is preferably made of a polymer which has a non-sticking surface such as Teflon. The insert 49 is ideally replaceable and can be fastened to the nipple 48 in any manner. The insert can be of any shape which causes the sheet of flush water to flow around the nipple. The flange 51 of the insert 49 is angled toward the bowl surface, so that any tendency of cascading water 53 to run along the insert toward the flange end is inhibited from going beyond the flange 51.

When the pump 44 is operating, preferably under control of a timed wall switch 54 from the time just before a person sits down until many minutes after the person is expected to leave the bathroom, air will be exhausted from the bowl 20. Before being seated, air will be brought into the tube 46 from the area immediately around the bowl 20. As soon as the person is seated, his or her buttocks and backs of the thighs seal on the seat. At that time, air intake for the tube 16 comes only from the usual space between the bottom of the seat and top of the rim 36, as well as any space between the individual's legs and buttocks and the seat. Thus, the volume evacuated while a person is seated is relatively small and easy to handle with the small diameter tube 46. By flowing outwardly from the bowl without passing a person's face and nostrils, gases and fumes from solid waste deposited in the water or remaining on the user's anus flow away from the person and to an attic, for example. Because of this, flushing while seated is no longer deemed necessary to avoid filling the bathroom with odor. Oftentimes, the hope is that the flushing will cleanse the bathroom air so that the next person occupying the bathroom need not put up with the odor of the previous user. If the noxious fumes can be removed at the source of the fumes, so to speak, they will not linger in the room and will not cause embarrassment for the creator of the fumes in the eyes of the next bathroom user.

Figure 2:
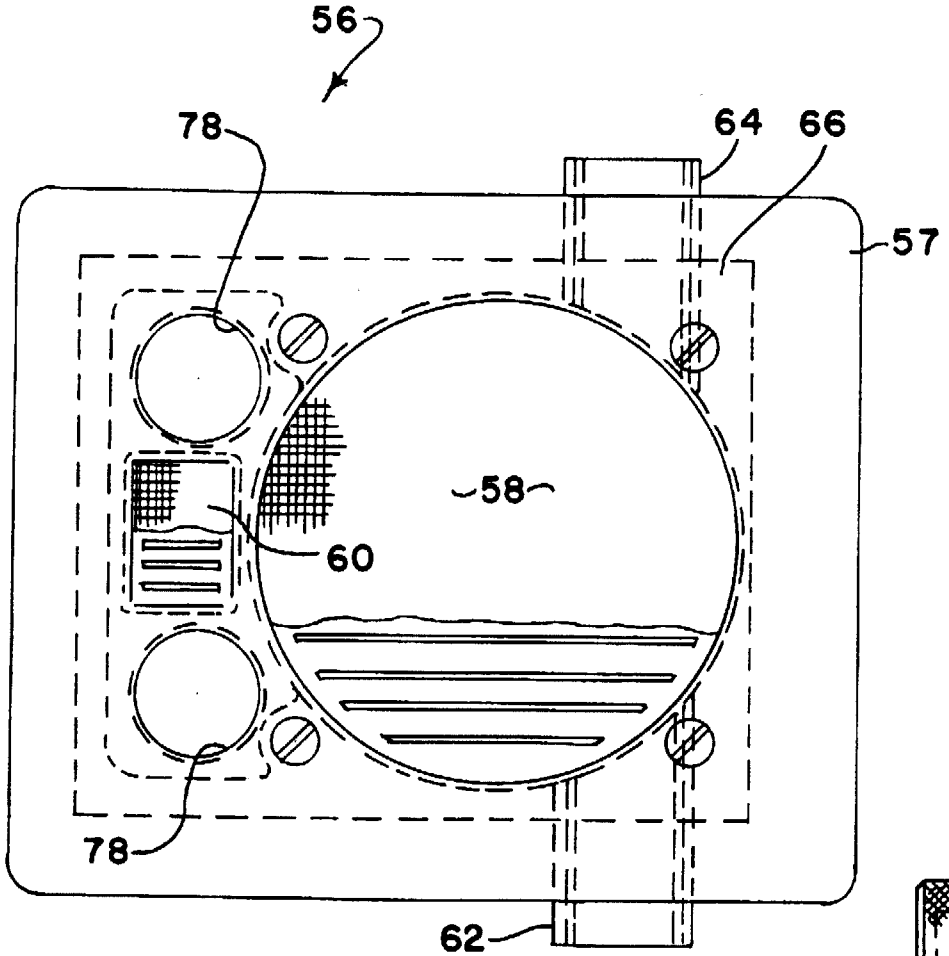

To further enhance use of the air evacuating system just described, I have found that the air flow can provide a convenient means for circulating air under very low velocity within the bathroom so as to either freshen or disinfect the air. This is simply shown in FIG. 1 as being an air circulating means 56 which is shown in greater detail in FIGS. 2–4. FIG. 2 shows a face plate 57 of the circulating means as having a pair of screens 58 and 60 which function oppositely as either an intake or outlet for air flow, depending on the direction of evacuating air flow through nipples 62 and 64 which are part of the housing 66 of the circulating means.

Figure 4:
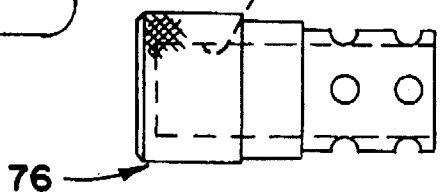

To first describe the operation of the circulating means 56, one enclosed chamber 65 in the housing 66 at the right side of FIG. 3 has a driving impeller 68 fixedly mounted on a freely rotatable shaft journaled in a wall separating chamber 65 from a chamber 67 which contains a driven impeller 72, also fixed to the same shaft 70. The side of chamber 67 facing the bathroom is in communication therewith. Flow in either direction between the nipples 62 and 64, which are connected to tube 46, will rotate drive impeller 68 and driven impeller 72. The unit will only operate in one direction once it has been installed, but the design enables an installer to mount the means 56 either as shown in FIG. 2, or upside down from that position by connecting it in the desired location in the bathroom, preferably a little distance above a person seated on the toilet. Air-directing louvers may be provided on the face of the air circulating means 56 to direct any air freshener or disinfectant away from the user's head or hair. A disinfectant or deodorant supply is provided by placing a small cylinder or cake of the desired material in a hollow space 74 in a tubular, removable container 76. A pair of containers 76 may be provided. They may be hand-threaded into openings 78 shown in FIG. 2. Air passageways are provided in chamber 67 of housing 66 so as to cause air to flow across the two containers 76 whether directed first through screen 60 and then screen 58 or vice versa.

A common legitimate female complaint relates to use of a toilet by standing males who splash urine and water during urination. While sometimes the droplets are too large to be affected by any evacuating air in the bowl, it is believed that some benefit can be achieved to minimize mist created during male urination. By simply turning on the pump 44 prior to urination by a male and turning it off when completed, the invention may be further beneficial for that particular use.

What has thus far been described is a system which provides air evacuation of a toilet bowl where a ceiling exhaust fan such as 16 is not provided or is at least not used for creating the air evacuation. At present, it is believed that no bathroom ceiling fan has the capability of completely closing off the air intake, although the design would be relatively simple once its potential is understood. This invention provides an opportunity to utilize a ceiling exhaust fan such as 16 to also provide the source of vacuum for exhausting air from the toilet bowl. In that situation, fan 44 would not be required, but the motor for the ceiling fan would have to be appropriately designed to provide the necessary evacuating flow from the bowl through tube 46. A tube 80 would lead from the fan 16 directly to the nipple 48, either with or without the air circulating means 56 being provided intermediate the fan and bowl.

Figure 5:
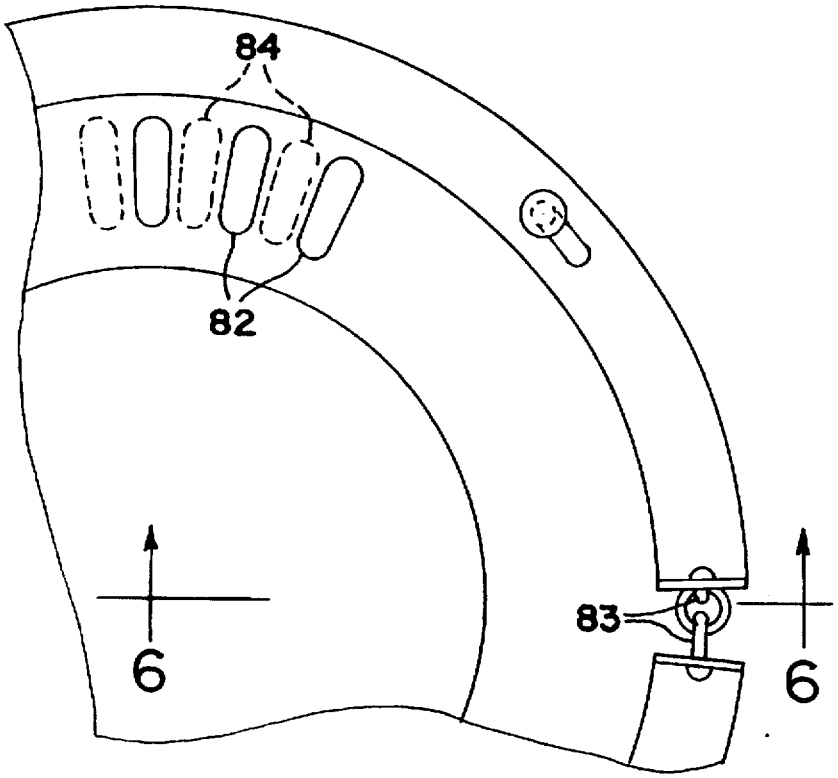
FIGS. 5 and 6 are fragmentary top plan and side elevational views of a portion of a ceiling exhaust fan which has been modified to enable its use as a conventional room exhaust fan during drawing air from the bathroom, or as the source of bowl evacuating air flow.
Figure 6:
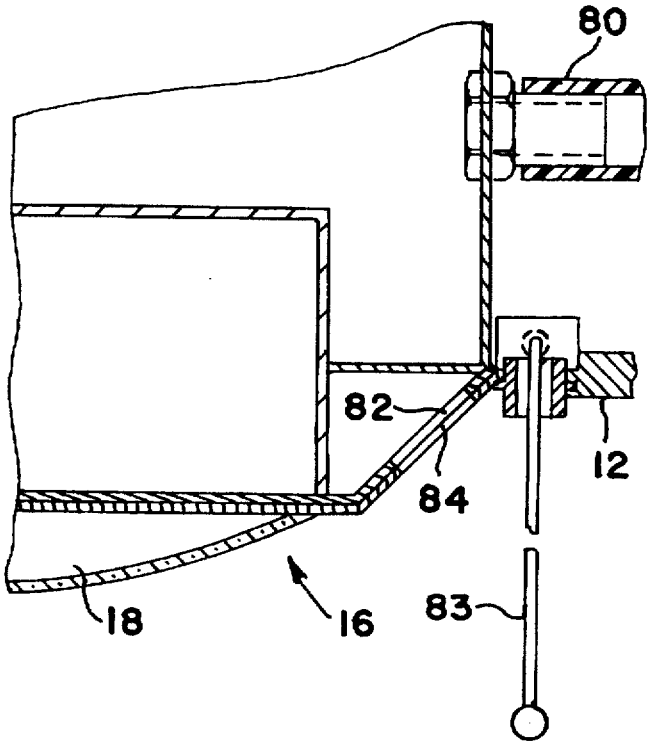

One such means for opening or closing the air intake for a ceiling fan is shown in FIGS. 5 and 6. It can be seen in FIG. 5 that holes 82 and 84 in two superimposed and separate plates are circumferentially offset, blocking off air flow to the impeller of the fan. By simply mechanically operating either of the two pull cords 83 or electrically operating a solenoid (not shown), the holes 82 and 84 can be placed in or out of alignment, to selectively permit moist air to be exhausted from the room or to inhibit air passage from the room and draw air through the tube 80, respectively. When in alignment, as shown in FIG. 6, air can enter the fan body through holes 82 and 84 as shown by the arrow. When out of alignment as shown in FIG. 5, the fan cannot draw air from the bathroom proper, and consequently, the air flow must come through tube 80 and the toilet bowl 20. Alternative structures for opening and closing the intake of the fan 16 are readily available, and are part of this invention only by virtue of the capability of being selectively opened or closed.

It should be understood that the hollow tube 46 is always open, allowing for some ventilation from the toilet bowl, even when the vacuum source is not operating. In addition, my system has no electrical components exposed to water or anything else detrimental to its proper operation. Furthermore, if any portion of the air evacuating system malfunctions, it has no adverse affect on the rest of the equipment. The toilet still operates as previously, but the air evacuation is absent.

Various other changes may be made without departing from the spirit and scope of the claims. For the sake of simplicity, some of the common motor and light controls have been mentioned only sketchily or not described at all. For example, the various protective means for the motors of pump 44 and fan 16, such as a thermal disconnect to prevent over-heating have not been shown or described because of their being well known.

Having described my invention, I claim:

1. An air evacuation system for a toilet having a bowl with an inner surface including a water-containing bottom, a frontal portion, a rear portion, an open seat-receiving top, a water trap for maintaining standing water at a predetermined level in said bowl and an upper peripheral rim for supporting a seat, a water outlet for conveying a sheet of water throughout the periphery of the bowl inner surface to supply water to said bowl during flushing and therefrom through said trap to a sewage system, the improvement comprising means for directly conveying airborne contents including gases, bacteria, viruses and liquid mist from said bowl through a room wall to an external area remote from a user of the toilet during and after use in defecation or urination and including:

an opening through said bowl in the rear portion thereof immediately below said rim and above the level of standing water;

said conveying means including a hollow tubing passing through said opening and extending to said remote area, said tubing having an inlet in said bowl for providing a conduit for passage of airborne contents from said bowl to said remote area, the inlet of said tubing extending generally horizontally inwardly of said bowl inner surface a sufficient distance and having an annular deflecting flange at the inlet whereby the inlet remains essentially unobstructed by the sheet of water flowing throughout the periphery of the bowl inner surface during flushing;

electrically-operable means for creating a vacuum in said tubing to conduct said airborne contents from said bowl to said remote area;

user-operable control means for selectively operating said vacuum-creating means;

a driving air impeller mounted in the path of air flow for rotation in response to air flow through said hollow tubing;

a shaft fixed to said driving air impeller and extending exteriorly of said path to the same side of said wall as said toilet; and a driven air-circulating impeller fixed to the extending portion of said shaft on that side of said wall above the bowl, said air-circulating impeller effecting circulation of room air in the vicinity of said toilet whenever air is caused to flow through said hollow tubing.

2. A system according to claim 1 wherein said air circulating means includes a housing for said driven air impeller, an air inlet and an air outlet for intake and exhaust of circulating air in response to said driven impeller being rotated by said driving impeller during air evacuation from said bowl, and a supply of air-exposed dispensing material intermediate said air inlet and air outlet of said air circulating means.

3. A system according to claim 2 wherein said dispensing material is in cake form and includes a disinfectant.

4. A system according to claim 2 wherein said dispensing material is in cake form and includes an air freshening deodorant.

5. A system according to claim 1 wherein said hollow tubing is flexible and wherein that portion of said tubing intermediate the rear portion of said bowl and said wall is covered with a second, aesthetically-pleasing tube.

* * * * *